US009943181B1

(12) United States Patent
Stack

(10) Patent No.: US 9,943,181 B1
(45) Date of Patent: Apr. 17, 2018

(54) PLATE CADDY

(71) Applicant: Thomas F. Stack, North Myrtle Beach, SC (US)

(72) Inventor: Thomas F. Stack, North Myrtle Beach, SC (US)

( * ) Notice: Subject to any disclaimer, the term of this patent is extended or adjusted under 35 U.S.C. 154(b) by 0 days.

(21) Appl. No.: 15/658,517

(22) Filed: Jul. 25, 2017

(51) Int. Cl.
*A47G 19/08* (2006.01)
*A47G 23/06* (2006.01)

(52) U.S. Cl.
CPC ..... *A47G 19/08* (2013.01); *A47G 23/0625* (2013.01)

(58) Field of Classification Search
CPC .... A47G 19/08; A47G 23/06; A47G 23/0625; A47G 23/0633; A47J 45/07; A47J 45/10
USPC ..... 294/32, 167, 169, 141, 142, 144, 172; 206/558
See application file for complete search history.

(56) References Cited

U.S. PATENT DOCUMENTS

| | | | | |
|---|---|---|---|---|
| 3,941,286 | A | 3/1976 | Perkinson | |
| 4,607,758 | A | 8/1986 | Stevens | |
| 5,353,952 | A | 10/1994 | Donche | |
| 5,634,568 | A | 6/1997 | Wawrzyniak | |
| D407,951 | S | 4/1999 | Philipson et al. | |
| 6,439,388 | B1 | 8/2002 | Lerner | |
| 7,267,244 | B1 * | 9/2007 | Dalhamer | A47G 23/06 220/574 |
| 7,717,483 | B1 * | 5/2010 | Bombara | A47G 23/0625 206/557 |
| 8,292,342 | B2 * | 10/2012 | Lord | A45F 5/00 220/914 |
| 8,381,912 | B2 * | 2/2013 | Dalhamer | B65D 1/34 206/557 |

FOREIGN PATENT DOCUMENTS

| | | | |
|---|---|---|---|
| DE | 202011100217 | * | 9/2011 |
| EP | 1346676 A1 | | 9/2003 |
| FR | 916161 | * | 11/1946 |

OTHER PUBLICATIONS

Coctail Tray. Translation of EP 1346676 Al [online]. Google Patents. [retrieved on May 15, 2017]. <URL:https://www.google.com/patents/EP1346676A1?cl=en>.

* cited by examiner

*Primary Examiner* — Dean J Kramer

(57) ABSTRACT

A plate caddy enables a user to carry up to two (2) dining plates using a single hand, while going through a buffet line, thereby providing a free hand to allow additional servicing of the user. The caddy includes a handle which is strapped securely to the user's hand, and a plurality of extended arms which act to support the plates while also securing the edge portions of the plates. The arms are adjustable to hold differently sized and shaped dinner plates, dessert plates, soup bowls, salad plates, and the like. The caddy may be quickly removed from the user's hand when desired.

20 Claims, 3 Drawing Sheets

PLATE CADDY

FIELD OF THE INVENTION

The present invention relates generally to the field of caddies and more specifically relates to a buffet salad plate caddy system.

BACKGROUND OF THE INVENTION

A buffet is a system of serving meals in which food is placed in a public area where the diners generally serve themselves. Buffets are offered at various places including hotels, restaurants and many social events. The essential feature of the various buffet formats is that the diners can directly view the food and immediately select which dishes they wish to consume, and usually also can decide how much food they take. Buffets are effective for serving large numbers of people at once.

A common problem encountered at social gatherings that include buffet style meals such as picnics, parties, and receptions where food is served while the guests are standing is the difficulty of holding both a dinner plate of food and another plate of food, such as a salad or bread plate, while at the same time keeping a hand free with which to serve themselves. Often diners will resort to setting down one (1) of the plates on any nearby flat surface, or will awkwardly try to hold all their plates in the same hand. Therefore, a suitable solution is required.

Various attempts have been made to solve problems found in caddy art. Among these are found in: U.S. Pat. No. 5,803,305 to Perlis; U.S. Pat. No. 6,149,027 to Rathjen; and U.S. Pat. No. 8,272,512 to Silfred. These prior art references are representative of plate caddy systems.

None of the above inventions and patents, taken either singly or in combination, is seen to describe the invention as claimed. Thus, a need exists for a reliable plate caddy system, and to avoid the above-mentioned problems.

SUMMARY OF THE INVENTION

In view of the foregoing disadvantages inherent in the prior art, it has been observed that there is need for a reliable plate caddy system.

The object of the present invention is to provide a caddy comprising a handle which comprises an upper and lower surface, a plurality of recessed areas which are disposed within the handle upper surface, a plurality of arm apertures which are disposed within the plurality of recessed areas, a plurality of arms, each having a first arm end which is moveably secured within an individual arm aperture and a second arm end, a plurality of bumpers, each secured to an individual second arm end and a strap disposed upon the handle lower surface. The plurality of arms is configured to adjustably rest beneath at least one (1) disk-shaped object. The plurality of bumpers is configured to adjustably stabilize at least one (1) disk-shaped object about a peripheral edge. The strap is configured to permit a user to insert a hand therein, thereby removably securing the caddy to the hand.

The plurality of recessed areas may also comprise a first recessed area which is disposed within a first corner of the handle, a second recessed area which is disposed within a second corner of the handle, a third recessed area which is disposed within a third corner of the handle and a fourth recessed area which is disposed within a fourth corner of the handle.

The first recessed area may comprise a first arm aperture which has the first arm end of a first one (1) of the plurality of arms moveably secured within and a second arm aperture which has the first arm end of a second one (1) of the plurality of arms moveably secured within. The second recessed area may comprise a third arm aperture which has the first arm end of a third one (1) of the plurality of arms moveably secured within and a second arm aperture which has the first arm end of a fourth one (1) of the plurality of arms moveably secured within. The third recessed area may comprise a fifth arm aperture which has the first arm end of a fifth one (1) of the plurality of arms moveably secured within and a sixth arm aperture which has the first arm end of a sixth one (1) of the plurality of arms moveably secured within. The fourth recessed area may comprise a seventh arm aperture which has the first arm end of a seventh one (1) of the plurality of arms moveably secured within and an eighth arm aperture which has the first arm end of an eighth one (1) of the plurality of arms moveably secured within.

The strap may comprise a first strap section and a second strap section which is capable of being removably secured to the first strap section. The plurality of bumpers may each comprise a tapered rubber stopper. The plurality of arms may each comprises a generally "Z"-shaped metallic rod. The handle may comprise polyoxymethylene.

In a separate embodiment, the caddy may comprise a handle having an upper and lower surface, a first plurality of recessed areas which are disposed within the handle upper surface, a second plurality of recessed areas which are disposed within the handle upper surface and located in mirror image to the first plurality of recessed areas, a plurality of first arm apertures disposed within the first plurality of recessed areas, a plurality of second arm apertures which are disposed within the second plurality of recessed areas, a plurality of first arms, each having a first arm first end which is moveably secured within an individual first arm aperture and a first arm second end, a plurality of second arms, each having a first arm end which is moveably secured within an individual second arm aperture and a second arm second end, a plurality of bumpers, each being secured to either an individual first arm second end or an individual second arm second end and a strap which is disposed upon the handle lower surface. The strap comprises a first strap section and a second strap section which is capable of being removably secured to the first strap section. The first plurality of arms and the second plurality of arms are configured to adjustably rest beneath at least one (1) disk-shaped object. The plurality of bumpers is configured to adjustably stabilize at least one (1) disk-shaped object about a peripheral edge. The strap is configured to permit a user to insert a hand therein thereby removably securing the caddy to the hand. A length of each of the first plurality of arms exceeds that of a length of each of the second plurality of arms.

The first plurality of recessed areas may comprise a first recessed area which is disposed within a first corner of the handle and a second recessed area disposed within a second corner of the handle. The second plurality of recessed areas may comprise a third recessed area which is disposed within a third corner of the handle and a fourth recessed area which is disposed within a fourth corner of the handle.

The first recessed area may comprise a first arm aperture which has the first arm first end from a first one (1) of the first plurality of arms moveably secured within and a second arm aperture which has the first arm first end from a second one (1) of the first plurality of arms moveably secured within. The second recessed area may comprise a third arm aperture which has the first arm first end from a third one (1) of the first plurality of arms moveably secured within and a fourth arm aperture having the first arm first end from a fourth one (1) of the first plurality of arms moveably secured within. The third recessed area may comprise another arm aperture which has the second arm first end from a first one (1) of the second plurality of arms moveably secured within and another arm aperture which has the second arm first end from a second one (1) of the second plurality of arms moveably secured within. The fourth recessed area may comprise another arm aperture which has the second arm first end from a third one (1) of the second plurality of arms moveably secured within and another arm aperture which has the second arm first end from a fourth one (1) of the second plurality of arms moveably secured within.

As with the first embodiment; the strap may comprise a first strap section and a second strap section which is capable of being removably secured to the first strap section; the plurality of bumpers may each comprise a tapered rubber stopper; and, the plurality of arms may each comprise a generally "Z"-shaped metallic rod. The handle may comprise polyoxymethylene.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
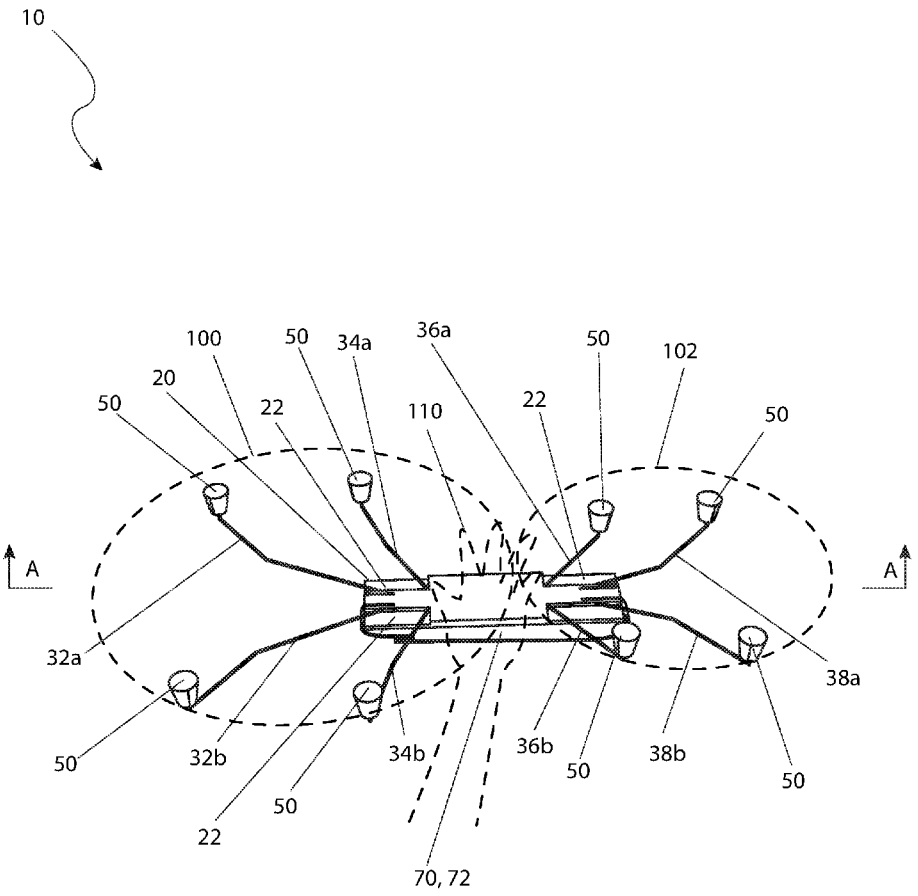
FIG. 1 is a top view of a plate caddy 10, according to a preferred embodiment of the present invention.

10 plate caddy
20 handle
22 recessed area
24 upper surface
26 lower surface
32*a* first long arm
32*b* second long arm
34*a* first short arm
34*b* second short arm
36*a* third short arm
36*b* fourth short arm
38*a* third long arm
38*b* fourth short arm
50 bumper
70 first hand strap section
72 second hand strap section
74*a* hook fastener
74*b* loop fastener
80 rivet fastener
82 arm aperture
100 first plate
102 second plate
110 user/user's hand

DETAILED DESCRIPTION OF THE PREFERRED EMBODIMENT

Figure 2:
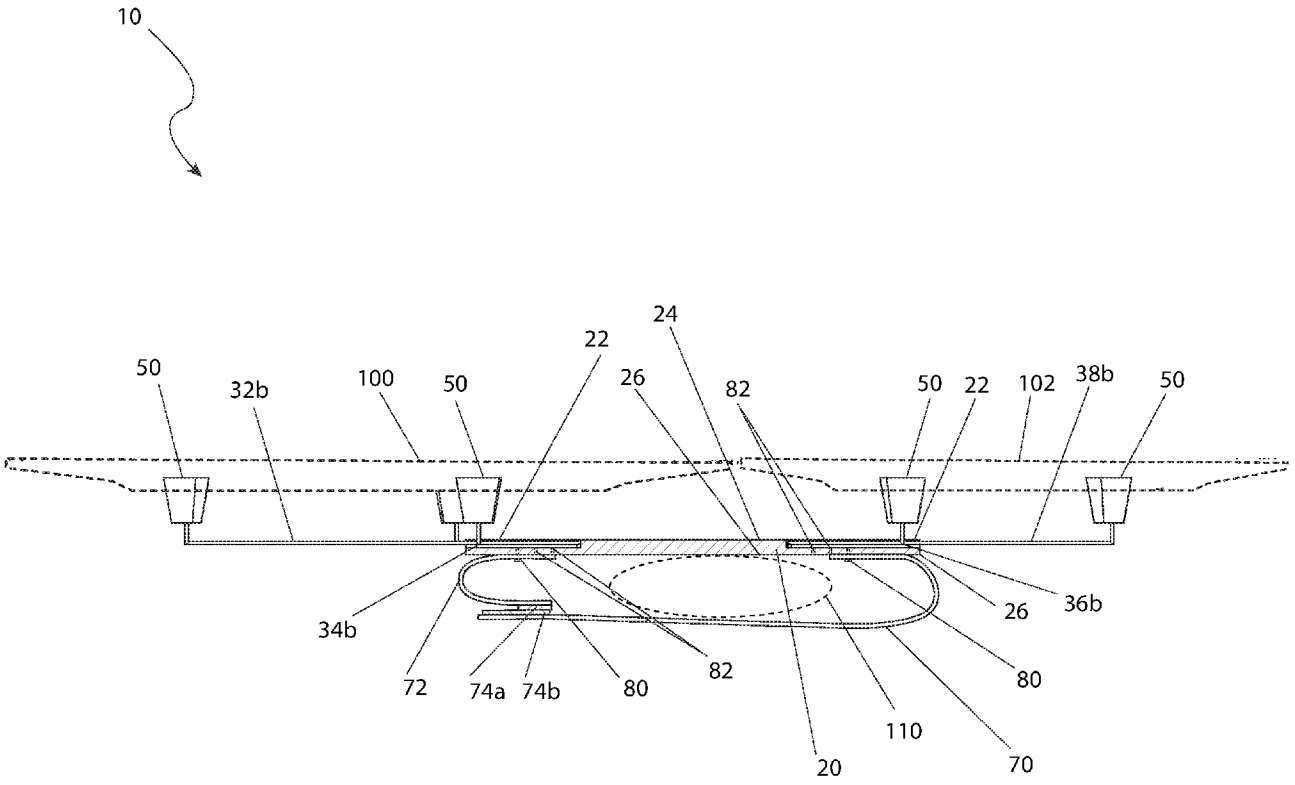
FIG. 2 is a side sectional view of the plate caddy 10, taken along section line A-A (see FIG. 1), according to an embodiment of the present invention; and, FIG. 3 is a top view of the plate caddy 10, depicting a stowed state, according to a preferred embodiment of the present invention.
Figure 3:
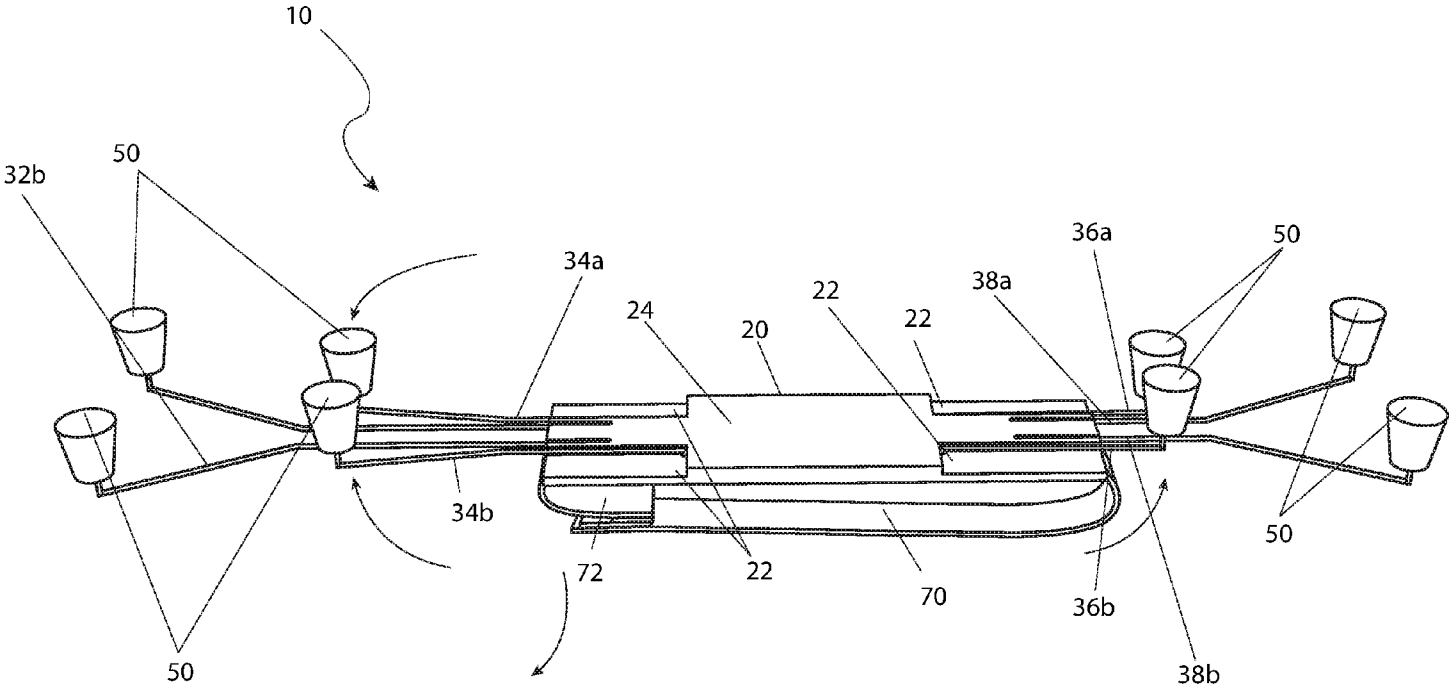

The best mode for carrying out the invention is presented in terms of its preferred embodiment, herein depicted within FIG. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a plate caddy (herein described as the "device") 10, which provides a means for a user 110 to carry up to two (2) plates 100, 102 while going through a buffet line, using a single hand 110, thereby providing a free hand to allow additional servicing of a user 110. The device 10 provides a rectangular handle 20 having a plurality of adjustable extending arms 32*a*, 32*b*, 34*a*, 34*b*, 36*a*, 36*b*, 38*a*, 38*b* which act to secure edge portions of the plates 100, 102. The handle 20 also provides attachment of the device 10 to a user's hand 110 via strap portions 70, 72. The user 110 may adjust the positions of the arms 32*a*, 32*b*, 34*a*, 34*b*, 36*a*, 36*b*, 38*a*, 38*b* so as to securely attach differently sized and shaped plates 100, 102. The plates 100, 102 may be quickly removed from the device 10, and the device 10 removed from the user's hand 110 once the user 110 is seated. It is appreciated that other disk-shaped objects similar to a dinner plate 100, 102 can be supported and carried with the device 10.

Referring now to FIGS. 1 and 2, top and sectional views of the device 10, according to a preferred embodiment of the present invention, are disclosed. The device 10 provides a rectangular handle 20, preferably made of Acetal Delrin (polyoxymethylene) material, or equivalent, having a plurality of affixed plate stabilizing arms 32*a*, 32*b*, 34*a*, 34*b*, 36*a*, 36*b*, 38*a*, 38*b*. The arms 32*a*, 32*b*, 34*a*, 34*b*, 36*a*, 36*b*, 38*a*, 38*b* form "Z"-shaped structures made using stainless steel rod stock, and being inserted into arm aperture portions 82 along an upper surface of the handle 20. An embodiment of the device 10 is shown here including a first long arm 32*a*, a second long arm 32*b*, a first short arm 34*a*, and a second short arm 34*b*, being affixed along a left side of the handle 20. Each arm 32*a*, 32*b*, 34*a*, 34*b* includes a respective affixed bumper 50. The arms 32*a*, 32*b*, 34*a*, 34*b* and bumpers 50 provide a means to receive and secure a larger first plate 100. In like manner, the device 10 includes a third short arm 36*a*, a fourth short arm 36*b*, a third long arm 38*a*, and a fourth long arm 38*b*, being positioned along a right side of the handle 20. Each arm 36*a*, 36*b*, 38*a*, 38*b* also includes a respective bumper 50, and enables securement of a smaller second plate 102. The device 10 is shown here being configured so as to secure a larger first plate 100 and a smaller second plate 102; however, it is understood that the teachings and features of the device 10 would enable securement of different-sized dinner plates, dessert plates, soup bowls, salad plates, and the like, as desired.

The handle 20 provides an upper surface 24 and a lower surface 26. The upper surface 24 further includes a plurality of recessed areas 22 in which horizontal portions of the arms 32*a*, 32*b*, 34*a*, 34*b*, 36*a*, 36*b*, 38*a*, 38*b* are positioned, thereby providing a coplanar surface made up of a top surface of the arms 32*a*, 32*b*, 34*a*, 34*b*, 36*a*, 36*b*, 38*a*, 38*b*, and the upper surface 24 of the handle 20. These coplanar surfaces act to support the plates 100 in a stable manner.

In the embodiment shown here, the downwardly extending proximal end portions of each long arm 32*a*, 32*b*, 38*a*, 38*b* are stationarily anchored within the arm apertures 82 within the recessed areas 22 of the handle 20. The arm apertures 82 are to be formed or drilled into the recessed areas 22. An embodiment of the long arms 32*a*, 32*b*, 38*a*, 38*b* is shown here being formed having respective intermediate divergent angles, thereby providing separation of the respective bumpers 50 in an "outrigger" style to stabilize the plates 100, 102 on each side. Additionally, the first 34*a* and second 34*b* short arms are shown here also being formed with divergent intermediate angles to enable securement of additional sizes and shapes of plates 100, 102. It is envisioned that the handle 20 may include additional recessed areas to accommodate portions of the user's hand 110, such as a thumb, thereby providing added stability and a more natural feel when holding the device 10.

The distal and upwardly extending end portions of each arm 32*a*, 32*b*, 34*a*, 34*b*, 36*a*, 36*b*, 38*a*, 38*b* are inserted into a respective rubber bumper 50. Each bumper 50 is perpendicularly secured at the distal end of each arm 32*a*, 32*b*, 34*a*, 34*b*, 36*a*, 36*b*, 38*a*, 38*b*, extending away from the upper surface 24. In a preferred embodiment, each rubber bumper 50 is envisioned to take the form of a tapered rubber stopper, thereby providing a high-friction contact with the plate 100, 102, and also acting to entrap edge portions of each plate 100, 102 when properly positioned.

The four (4) short arms 34*a*, 34*b*, 36*a*, 36*b* are also anchored to the handle 20 via arm apertures 82; however, the short arms 34*a*, 34*b*, 36*a*, 36*b* are inserted into respective arm apertures 82 via a friction fit, or equally effective means to resist rotation, thereby allowing selective temporary positioning of the short arms 34*a*, 34*b*, 36*a*, 36*b* by pivoting relative to the handle 20, and being maintained at the selected position via the friction fit connection. The first 34*a* and second 34*b* short arms act to compliment the previously described first 32*a* and second 32*b* long arms, while the third 36*a* and fourth 36*b* short arms act to compliment the previously described third 38*a* and fourth 38*b* long arms. The pivoting nature of the short arms 34*a*, 34*b*, 36*a*, 36*b*, along with the stationarily positioned long arms 32*a*, 32*b*, 38*a*, 38*b*, allow the securement of differently sized and shaped plates 100, 102. In use, the plates 100, 102 are initially positioned against the bumper portions 50 of the long arms 32*a*, 32*b*, 38*a*, 38*b*, followed by pivoting the bumper portions 50 of the short arms 34*a*, 34*b*, 36*a*, 36*b* inwardly until the bumpers 50 contact the opposing edge portions of the plates 100, 102. In this manner, the device 10 enables contact upon four (4) points along a perimeter edge of each plate 100, 102 in a stabilizing manner.

It is envisioned that the device 10 may hold one (1) or two (2) dinner plates 100, or a dinner plate 100 with a second smaller plate 102. It is further envisioned that the device 10 may secure additional items in like manner such as, but not limited to: dessert plates, soup bowls, salad plates, and the like. The overall size of the device 10 in an extended state is approximately six inches to ten inches (6-10 in.) in width and approximately ten inches to fourteen inches (10-14 in.) in length. The upper surface 24 of the device 10 is preferably coated with a high-friction finish such as silicone rubber, or the like, in order to prevent slippage of the plates 100, 102 during use. The device 10 is to be dishwasher safe to allow cleaning after each use.

The handle 20 provides a first hand strap section 70 and a second hand strap section 72 which are wrapped around a user's hand 110 for improved stability during use. The hand strap sections 70, 72 are attached to each other via sewn-on hook fastener 74*a* and loop fastener 74*b* portions. Each hand strap section 70, 72 is affixed to opposing ends of the lower surface 26 using rivet fasteners 80 or an equivalent joining means. The hand strap sections 70, 72 are preferably made of a seventy (70%) percent polyester and thirty (30%) percent rubber blend. The strap sections 70, 72 would accommodate many different sizes of user's hands 110 and would be utilized equally by either right-handed or left-handed users 110.

Referring now to FIG. 3, a top view of the device 10 depicting a stowed state, according to a preferred embodiment of the present invention, is disclosed. The short arm portions 34*a*, 34*b*, 36*a*, 36*b* of the device 10 may be pivoted inwardly against the handle 20 in a compact configuration of the device 10 for easy storage. This compact state of the device 10 allows a plurality of units of the device 10 to be conveniently positioned and/or stacked upon a buffet line. The compact collapsed state of the device 10 also allows a user 110 to easily store the device 10 until needed again.

It is understood that the exact specifications, materials used, and method of use of the device 10 may vary upon manufacturing. It is envisioned that other styles and configurations of the present invention can be easily incorporated into the teachings of the present invention, and only one (1) particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: procuring the device 10; placing the lower surface portion 26 of the handle 20 upon a user's hand 110; wrapping the first hand strap section 70 and second hand strap section 72 around the user's hand 110; pressing the hook fastener 74*a* and loop fastener 74*b* portions to join the hand strap sections 70, 72 together; pivoting the short arm portions 34*a*, 34*b*, 36*a*, 36*b* away from the handle 20; positioning a plate 100, 102 against the stationary bumper portions 50 of the long arms 32*a*, 32*b*, 38*a*, 38*b*; securing the position of the plate 100, 102 by pivoting the short arms 34*a*, 34*b*, 36*a*, 36*b* inwardly until the bumper portions 50 contact the edge portions of the plates 100, 102 opposite the long arms 32*a*, 32*b*, 38*a*, 38*b*; repeating the previous steps to install a second plate 100, 102; visiting a buffet serving table; loading the plates 100, 102 with food stuffs while holding the device 10 using one (1) hand 110; utilizing the other free hand to perform additional servicing of the user 110; and, benefiting from secure positioning of multiple plates 100, 102 using a single hand 110 while visiting a buffet line, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A caddy comprising:
a handle comprising:
a handle upper surface; and,
a handle lower surface;
a plurality of recessed areas disposed within said handle upper surface;
a plurality of arm apertures disposed within said plurality of recessed areas;
a plurality of arms, each having a first arm end moveably secured within an individual arm aperture and a second arm end;
a plurality of bumpers, each secured to an individual second arm end; and,
a strap disposed upon said handle lower surface;
wherein said plurality of arms is configured to adjustably rest beneath at least one disk-shaped object;
wherein said plurality of bumpers is configured to adjustably stabilize at least one disk-shaped object about a peripheral edge thereof; and,
wherein said strap is configured to permit a user to insert a hand therewithin, thereby removably securing said caddy to said hand.

2. The caddy of claim 1, wherein said plurality of recessed areas comprises:
a first recessed area disposed within a first corner of said handle;
a second recessed area disposed within a second corner of said handle;
a third recessed area disposed within a third corner of said handle; and,
a fourth recessed area disposed within a fourth corner of said handle.

3. The caddy of claim 2, wherein said first recessed area comprises:
a first arm aperture having said first arm end of a first one of said plurality of arms moveably secured within; and,
a second arm aperture having said first arm end of a second one of said plurality of arms moveably secured within.

4. The caddy of claim 3, wherein said second recessed area comprises:
a third arm aperture having said first arm end of a third one of said plurality of arms moveably secured within; and,
a second arm aperture having said first arm end of a fourth one of said plurality of arms moveably secured within.

5. The caddy of claim 4, wherein said third recessed area comprises:
a fifth arm aperture having said first arm end of a fifth one of said plurality of arms moveably secured within; and,
a sixth arm aperture having said first arm end of a sixth one of said plurality of arms moveably secured within.

6. The caddy of claim 5, wherein said fourth recessed area comprises:
a seventh arm aperture having said first arm end of a seventh one of said plurality of arms moveably secured within; and,
an eighth arm aperture having said first arm end of an eighth one of said plurality of arms moveably secured within.

7. The caddy of claim 1, wherein said strap comprises:
a first strap section; and,
a second strap section capable of being removably secured to said first strap section.

8. The caddy of claim 1, wherein said plurality of bumpers each comprises a tapered rubber stopper.

9. The caddy of claim 1, wherein said plurality of arms each comprises a generally Z-shaped metallic rod.

10. The caddy of claim 1, wherein said handle comprises polyoxymethylene.

11. A caddy comprising:
a handle comprising:
a handle upper surface; and,
a handle lower surface;
a first plurality of recessed areas disposed within said handle upper surface;
a second plurality of recessed areas disposed within said handle upper surface located in mirror image to said first plurality of recessed areas;
a plurality of first arm apertures disposed within said first plurality of recessed areas;
a plurality of second arm apertures disposed within said second plurality of recessed areas;
a plurality of first arms, each having a first arm first end moveably secured within an individual first arm aperture, and a first arm second end;
a plurality of second arms, each having a second arm first end moveably secured within an individual second arm aperture, and a second arm second end;
a plurality of bumpers, each secured to either an individual first arm second end or an individual second arm second end; and,
a strap disposed upon said handle lower surface, comprising:
a first strap section; and,
a second strap section capable of being removably secured to said first strap section;
wherein said first plurality of arms and said second plurality of arms are configured to adjustably rest beneath at least one disk-shaped object;
wherein said plurality of bumpers is configured to adjustably stabilize at least one disk-shaped object about a peripheral edge thereof;
wherein said strap is configured to permit a user to insert a hand therewithin, thereby removably securing said caddy to said hand; and,
wherein a length of each of said first plurality of arms exceeds that of a length of each of said second plurality of arms.

12. The caddy of claim 11, wherein said first plurality of recessed areas comprises:
a first recessed area disposed within a first corner of said handle; and,
a second recessed area disposed within a second corner of said handle.

13. The caddy of claim 12, wherein said first recessed area comprises:
a first arm aperture having said first arm first end from a first one of said first plurality of arms moveably secured within; and,
a second arm aperture having said first arm first end from a second one of said first plurality of arms moveably secured within.

14. The caddy of claim 13, wherein said second recessed area comprises:
a third arm aperture having said first arm first end from a third one of said first plurality of arms moveably secured within; and,
a fourth arm aperture having said first arm first end from a fourth one of said first plurality of arms moveably secured within.

15. The caddy of claim 11, wherein said second plurality of recessed areas comprises:

a third recessed area disposed within a third corner of said handle; and, a fourth recessed area disposed within a fourth corner of said handle.

16. The caddy of claim 15, wherein said third recessed area comprises:

a first arm aperture having said second arm first end from a first one of said second plurality of arms moveably secured within; and, a second arm aperture having said second arm first end from a second one of said second plurality of arms moveably secured within.

17. The caddy of claim 16, wherein said fourth recessed area comprises:

a third arm aperture having said second arm first end from a third one of said second plurality of arms moveably secured within; and, a fourth arm aperture having said second arm first end from a fourth one of said second plurality of arms moveably secured within.

18. The caddy of claim 11, wherein said plurality of bumpers each comprises a tapered rubber stopper.

19. The caddy of claim 11, wherein said plurality of arms each comprises a generally Z-shaped metallic rod.

20. The caddy of claim 11, wherein said handle comprises polyoxymethylene.

* * * * *